US012565998B2

(12) United States Patent
Sharma et al.

(10) Patent No.: US 12,565,998 B2
(45) Date of Patent: Mar. 3, 2026

(54) COMBUSTOR FOR A GAS TURBINE ENGINE INCLUDING A COLLAR SURROUNDING A SECONDARY FUEL INJECTOR TO DEFINE UPSTREAM AND DOWNSTREAM PURGE PATHS

(71) Applicant: Siemens Energy Global GmbH & Co. KG, Munich (DE)

(72) Inventors: Jaishree Sharma, Oviedo, FL (US); Landon Tully, Charlotte, NC (US); Rohit Khattar, Charlotte, NC (US); Sudeep Bosu, Charlotte, NC (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 18/291,951

(22) PCT Filed: Aug. 2, 2021

(86) PCT No.: PCT/US2021/044163
§ 371 (c)(1),
(2) Date: Jan. 25, 2024

(87) PCT Pub. No.: WO2023/014343
PCT Pub. Date: Feb. 9, 2023

(65) Prior Publication Data

US 2024/0377066 A1 Nov. 14, 2024

(51) Int. Cl.

| | |
|---|---|
| ***F23R 3/28*** | (2006.01) |
| ***F23R 3/06*** | (2006.01) |
| ***F23R 3/34*** | (2006.01) |

(52) U.S. Cl.
CPC ..... *F23R 3/286* (2013.01); *F23R 3/06* (2013.01); *F23R 3/283* (2013.01); *F23R 3/34* (2013.01); *F23R 3/346* (2013.01)

(58) Field of Classification Search
CPC .... F23R 3/34; F23R 3/346; F23R 3/06; F23R 3/286; F23R 3/283
See application file for complete search history.

(56) References Cited

U.S. PATENT DOCUMENTS

| | | |
|---|---|---|
| 2,926,495 A | 3/1960 | Benson et al. |
| 3,139,724 A | 7/1964 | Nerad et al. |

(Continued)

OTHER PUBLICATIONS

PCT International Search Report and Written Opinion of International Searching Authority mailed Apr. 13, 2022 corresponding to PCT International Application No. PCT/US2021/044163 filed Aug. 2, 2021.

*Primary Examiner* — Thomas P Burke

(57) ABSTRACT

A combustor includes a premixer fuel injector that injects fuel into the combustor and ignites mixture of the fuel and compressed air to produce exhaust gas, a transition duct through which the exhaust gas passes, a secondary fuel injector disposed in an opening of the transition duct for providing further fuel to the exhaust gas, and a collar fixedly coupled to the transition duct and positioned to surround the secondary fuel injector. The collar cooperates with the secondary fuel injector to define an upstream purge path disposed on an upstream side of the opening and a downstream purge path disposed on a downstream side of the opening by a flow direction of the exhaust gas that each provides a flow communication between an exterior of the transition duct and an interior of the transition duct. The upstream purge path has a larger flow area than the downstream purge path.

19 Claims, 5 Drawing Sheets

(56) References Cited

U.S. PATENT DOCUMENTS 4,132,066 A * 1/1979 Austin, Jr. ..... F23R 3/06 60/752
4,875,339 A * 10/1989 Rasmussen ..... F23R 3/045 60/757
4,887,432 A * 12/1989 Mumford ..... F23R 3/045 60/759
7,013,634 B2 * 3/2006 Pidcock ..... F23R 3/60 60/39.821
10,837,641 B2 11/2020 Ogata et al.
2006/0042256 A1 * 3/2006 Storey ..... F23R 3/06 60/752
2007/0068166 A1 * 3/2007 Gautier ..... F23R 3/283 60/752
2009/0235668 A1 * 9/2009 Johnson ..... F23R 3/06 60/39.83
2014/0007580 A1 * 1/2014 Richardson ..... F23R 3/06 60/722
2015/0047360 A1 * 2/2015 Baruah ..... F23R 3/346 60/746
2015/0198332 A1 7/2015 Dicintio et al.
2015/0211420 A1 * 7/2015 Sze ..... F23R 3/02 60/776
2015/0241063 A1 * 8/2015 Bangerter ..... F23R 3/002 60/754
2015/0285501 A1 * 10/2015 DiCintio ..... F23R 3/346 60/740
2015/0354818 A1 * 12/2015 Lebel ..... F02C 7/28 60/796
2016/0208704 A1 * 7/2016 Bouldin ..... F23R 3/002
2017/0268786 A1 * 9/2017 Cai ..... F23R 3/283
2018/0363561 A1 * 12/2018 Gonyou ..... F02C 7/28
2019/0178496 A1 * 6/2019 Jones ..... F23R 3/045
2019/0293294 A1 * 9/2019 Hucker ..... F23R 3/60
2019/0301738 A1 10/2019 North et al.
2019/0353351 A1 * 11/2019 Bunel ..... F02C 7/22
2022/0235936 A1 * 7/2022 Leparoux ..... F23R 3/002
2024/0271785 A1 * 8/2024 Joshi ..... F23R 3/06

* cited by examiner

COMBUSTOR FOR A GAS TURBINE ENGINE INCLUDING A COLLAR SURROUNDING A SECONDARY FUEL INJECTOR TO DEFINE UPSTREAM AND DOWNSTREAM PURGE PATHS

BACKGROUND

A gas turbine engine typically includes a compressor section, a turbine section, and a combustion section disposed therebetween. The compressor section includes multiple stages of rotating compressor blades and stationary compressor vanes. The combustion section typically includes a plurality of combustors. The turbine section includes multiple stages of rotating turbine blades and stationary turbine vanes.

The combustor may include fuel injectors for providing a fuel to be mixed with compressed air from the compressor section and an ignition source for igniting the mixture to form hot exhaust gas for the turbine section. Gas turbine combustion can produce undesirable emissions including unburnt hydrocarbons. In addition, operation at higher temperatures results in higher efficiency. It is therefore desirable to operate at the highest temperature possible and to assure thorough combustion within the combustor.

BRIEF SUMMARY

In one aspect, a combustor includes a premixer fuel injector that injects a fuel into the combustor and ignites a mixture of the fuel and a compressed air to produce an exhaust gas. The combustor includes a transition duct defining an interior through which the exhaust gas passes. The transition duct defines an opening therethrough. The opening has an upstream side and a downstream side defined by a flow direction of the exhaust gas. The combustor includes a secondary fuel injector disposed in the opening that injects further fuel to the exhaust gas. The combustor includes a collar fixedly coupled to the transition duct and positioned to surround the secondary fuel injector. The collar has a first end positioned to an exterior of the transition duct, a second end fixed on the transition duct around the opening, and a wall therebetween. The collar cooperates with the secondary fuel injector to define an upstream purge path at least partially disposed on the upstream side and a downstream purge path at least partially disposed on the downstream side that each provides a flow communication between the exterior of the transition duct and the interior of the transition duct. The upstream purge path has a larger flow area than the downstream purge path.

In one aspect, a combustor includes a transition duct defining an interior through which a flow of combustion gas passes in a flow direction. The transition duct defines an opening therethrough. The opening has an upstream side and a downstream side defined by the flow direction. The combustor includes a secondary fuel injector at least partially disposed within the opening to inject fuel into the flow of combustion gas. The combustor includes a collar fixedly coupled to the transition duct and positioned to surround the opening. The collar cooperates with the secondary fuel injector to define an upstream purge path at least partially disposed on the upstream side of the opening and a downstream purge path at least partially disposed on the downstream side of the opening that each provides a flow communication between an exterior of the transition duct and the interior of the transition duct. The upstream purge path has a larger flow area than the downstream purge path.

In one aspect, a combustor includes a transition duct defining an interior through which a flow of combustion gas passes in a flow direction. The transition duct defines an opening therethrough. The opening has an upstream side and a downstream side defined by the flow direction. The combustor includes a secondary fuel injector at least partially disposed within the opening to inject fuel into the flow of combustion gas. The combustor includes a collar fixedly coupled to the transition duct and positioned to surround the opening. The collar cooperates with the secondary fuel injector to define an upstream purge path at least partially disposed on the upstream side of the opening and a downstream purge path at least partially disposed on the downstream side of the opening that each provides a flow communication between an exterior of the transition duct and the interior of the transition duct. The upstream purge path has a larger flow area than the downstream purge path. The collar includes a plurality of upstream apertures facing the upstream side of the opening and a plurality of downstream apertures facing the downstream side of the opening. The plurality of upstream apertures define the upstream purge path and the plurality of downstream apertures define the downstream purge path. A size of each upstream aperture of the plurality of upstream apertures is larger than a size of each downstream aperture of the plurality of downstream apertures. A total number of the plurality of upstream apertures is more than a total number of the plurality of downstream apertures. The upstream purge path has a larger circumferential length around a perimeter of the collar than the downstream purge path. The upstream purge path and the downstream purge path are separated by two ribs disposed in an inner surface of the collar.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
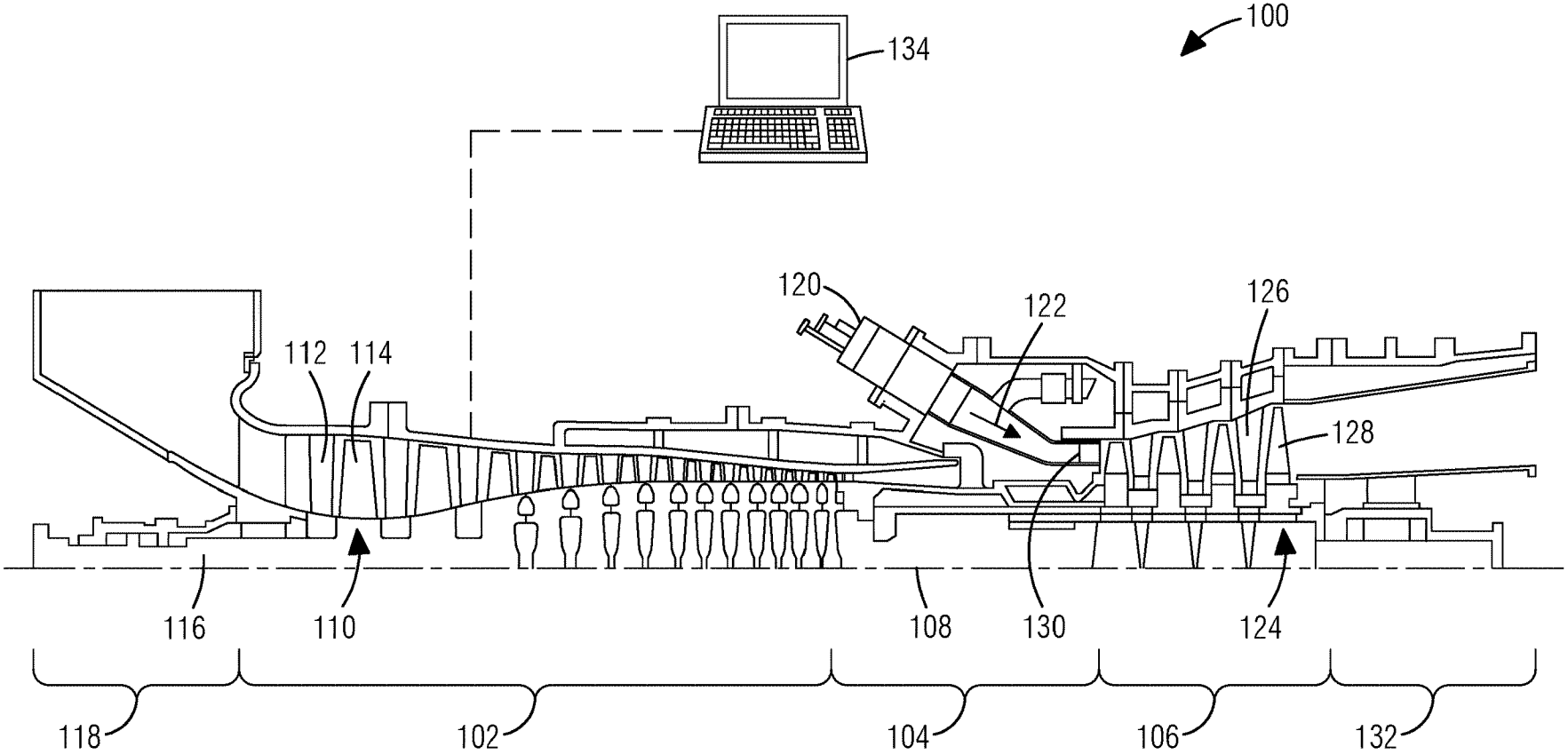
FIG. 1 is a longitudinal cross-sectional view of a gas turbine engine taken along a plane that contains a longitudinal axis or central axis.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

Also, in the description, the terms "axial" or "axially" refer to a direction along a longitudinal axis of a gas turbine engine. The terms "radial" or "radially" refer to a direction perpendicular to the longitudinal axis of the gas turbine engine. The terms "downstream" or "aft" refer to a direction along a flow direction. The terms "upstream" or "forward" refer to a direction against the flow direction.

In addition, the term "adjacent to" may mean: that an element is relatively near to but not in contact with a further element; or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates an example of a gas turbine engine 100 including a compressor section 102, a combustion section 104, and a turbine section 106 arranged along a central axis 108. The compressor section 102 includes a plurality of compressor stages 110 with each compressor stage 110 including a set of stationary compressor vanes 112 or adjustable guide vanes and a set of rotating compressor blades 114. A rotor 116 supports the rotating compressor blades 114 for rotation about the central axis 108 during operation. In some constructions, a single one-piece rotor 116 extends the length of the gas turbine engine 100 and is supported for rotation by a bearing at either end. In other constructions, the rotor 116 is assembled from several separate spools that are attached to one another or may include multiple disk sections that are attached via a bolt or plurality of bolts.

The compressor section 102 is in fluid communication with an inlet section 118 to allow the gas turbine engine 100 to draw atmospheric air into the compressor section 102. During operation of the gas turbine engine 100, the compressor section 102 draws in atmospheric air and compresses that air for delivery to the combustion section 104. The illustrated compressor section 102 is an example of one compressor section 102 with other arrangements and designs being possible.

In the illustrated construction, the combustion section 104 includes a plurality of separate combustors 120 that each operates to mix a flow of fuel with the compressed air from the compressor section 102 and to combust that air-fuel mixture to produce a flow of high temperature, high pressure combustion gas or exhaust gas 122. Of course, many other arrangements of the combustion section 104 are possible.

The turbine section 106 includes a plurality of turbine stages 124 with each turbine stage 124 including a number of stationary turbine vanes 126 and a number of rotating turbine blades 128. The turbine stages 124 are arranged to receive the exhaust gas 122 from the combustion section 104 at a turbine inlet 130 and expand that gas to convert thermal and pressure energy into rotating or mechanical work. The turbine section 106 is connected to the compressor section 102 to drive the compressor section 102. For gas turbine engines 100 used for power generation or as prime movers, the turbine section 106 is also connected to a generator, pump, or other device to be driven. As with the compressor section 102, other designs and arrangements of the turbine section 106 are possible.

An exhaust portion 132 is positioned downstream of the turbine section 106 and is arranged to receive the expanded flow of exhaust gas 122 from the final turbine stage 124 in the turbine section 106. The exhaust portion 132 is arranged to efficiently direct the exhaust gas 122 away from the turbine section 106 to assure efficient operation of the turbine section 106. Many variations and design differences are possible in the exhaust portion 132. As such, the illustrated exhaust portion 132 is but one example of those variations.

A control system 134 is coupled to the gas turbine engine 100 and operates to monitor various operating parameters and to control various operations of the gas turbine engine 100. In preferred constructions the control system 134 is typically micro-processor based and includes memory devices and data storage devices for collecting, analyzing, and storing data. In addition, the control system 134 provides output data to various devices including monitors, printers, indicators, and the like that allow users to interface with the control system 134 to provide inputs or adjustments. In the example of a power generation system, a user may input a power output set point and the control system 134 may adjust the various control inputs to achieve that power output in an efficient manner.

The control system 134 can control various operating parameters including, but not limited to variable inlet guide vane positions, fuel flow rates and pressures, engine speed, valve positions, generator load, and generator excitation. Of course, other applications may have fewer or more controllable devices. The control system 134 also monitors various parameters to assure that the gas turbine engine 100 is operating properly. Some parameters that are monitored may include inlet air temperature, compressor outlet temperature and pressure, combustor outlet temperature, fuel flow rate, generator power output, bearing temperature, and the like. Many of these measurements are displayed for the user and are logged for later review should such a review be necessary.

Figure 2:
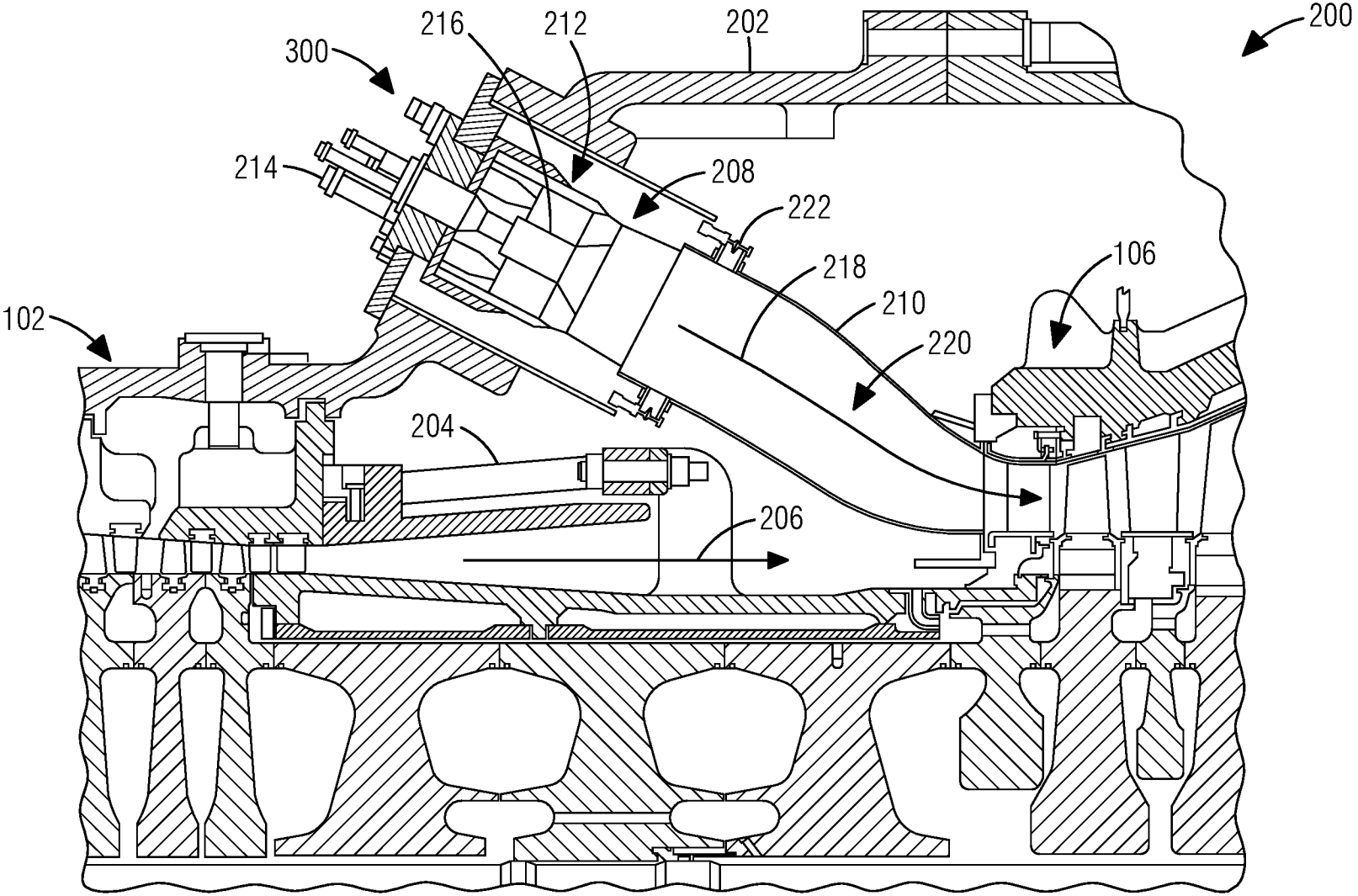
FIG. 2 illustrates a longitudinal cross-sectional view of a combustion section of the gas turbine engine of FIG. 1.

FIG. 2 illustrates a longitudinal cross-sectional view of a combustion section 200 suitable for use in the gas turbine engine 100 of FIG. 1. The combustion section 200 may replace the combustion section 104 of FIG. 1.

The combustion section 200 includes a casing 202 and a combustor 300 that is enclosed by the casing 202. A plurality of combustors 300 are arranged circumferentially around the central axis 108 of the gas turbine engine 100 and spaced apart from each other to define a can-type combustor, with other arrangements being possible. The plurality of combustors 300 are enclosed by the casing 202. A compressor exit diffusor 204 is connected to the exit of the compressor section 102 for providing compressed air 206 to the combustor 300.

Each combustor 300 includes a head-end section 208 that is connected to a transition duct 210. The head-end section 208 includes a premixer fuel injector 212 that includes a premixer fuel supply tube 214 and a pilot burner 216. The premixer fuel supply tube 214 injects fuel to the combustor 300. The fuel is mixed with the compressed air 206 and is ignited by the pilot burner 216 for producing exhaust gas 218. The transition duct 210 encloses an interior that defines a combustion chamber 220 through which the exhaust gas 218 passes. The exit of the transition duct 210 is connected to the entrance of the turbine section 106 such that the exhaust gas 218 enters the turbine section 106.

The combustor 300 includes one or more secondary fuel injectors 222 that are arranged downstream of the premixer fuel injector 212 and at an upstream side of the transition duct 210. The secondary fuel injectors 222 inject further fuel into the combustion chamber 220.

Figure 3:
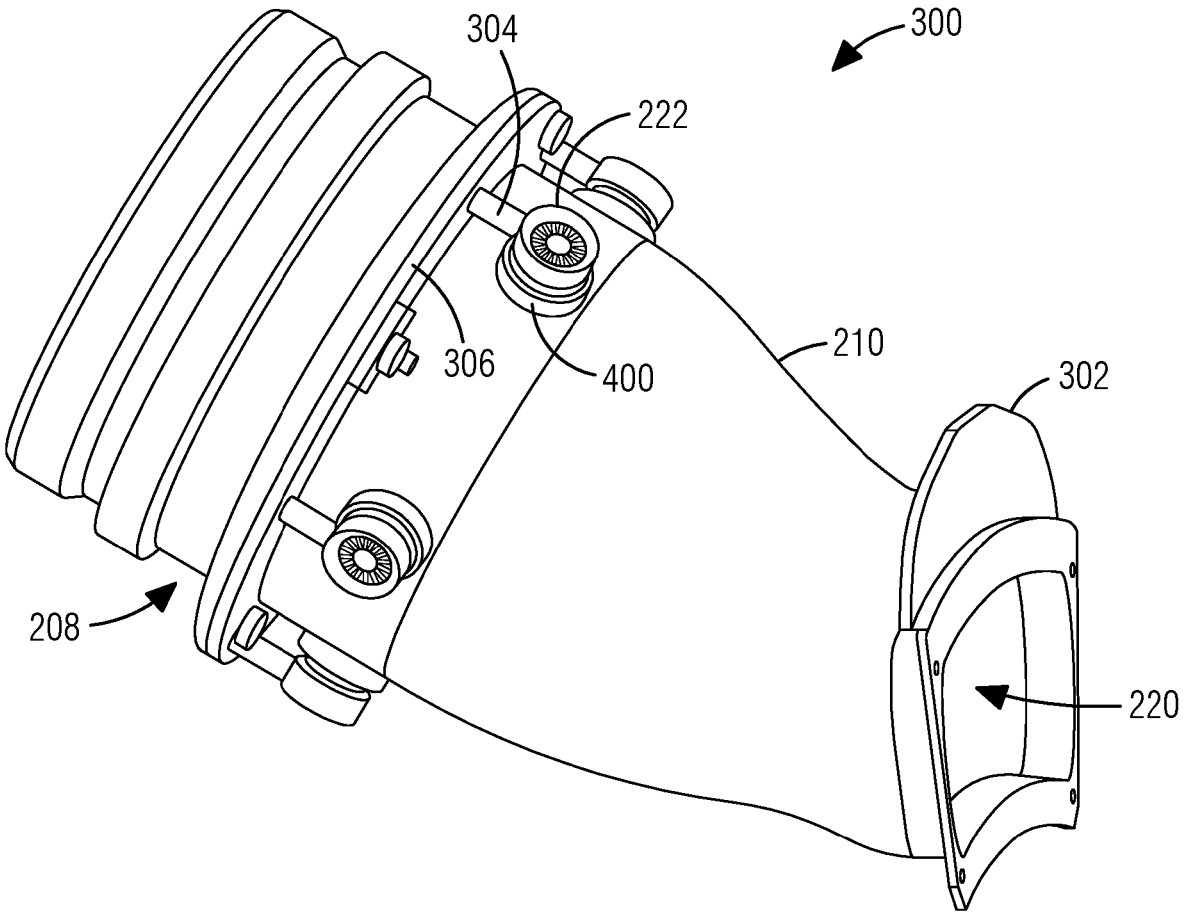
FIG. 3 illustrates a perspective view of a combustor suitable for use in the combustion section of FIG. 2.

FIG. 3 illustrates a perspective view of the combustor 300 as illustrated in the combustion section 200 of FIG. 2. The combustor 300 includes a transition exit frame 302 arranged at the exit of the transition duct 210. The transition exit frame 302 is connected to the turbine section 106 as illustrated in FIG. 2.

The combustor 300 includes a collar 400. The collar 400 is fixedly coupled to the transition duct 210. The collar 400 may be fixed on the transition duct 210 by welding. Other suitable fixing arrangements may be used to couple the collar 400 to the transition duct 210.

The secondary fuel injector 222 is disposed at the transition duct 210 to allow a flow communication with the combustion chamber 220. The secondary fuel injector 222 is disposed perpendicular to the transition duct 210. It is possible that the secondary fuel injector 222 may be disposed oblique to the transition duct 210. The secondary fuel injector 222 has a general cylindrical shape. A fuel supply tube 304 is connected to a fuel plenum ring 306 and the secondary fuel injector 222 for providing further fuel to the combustion chamber 220. The secondary fuel injector 222 is surrounded by the collar 400. A plurality of secondary fuel injectors 222 may be disposed circumferentially around the transition duct 210 and spaced apart from each other. Each secondary fuel injector 222 is connected to one fuel supply tube 304 and is surrounded by one collar 400.

Figure 4:
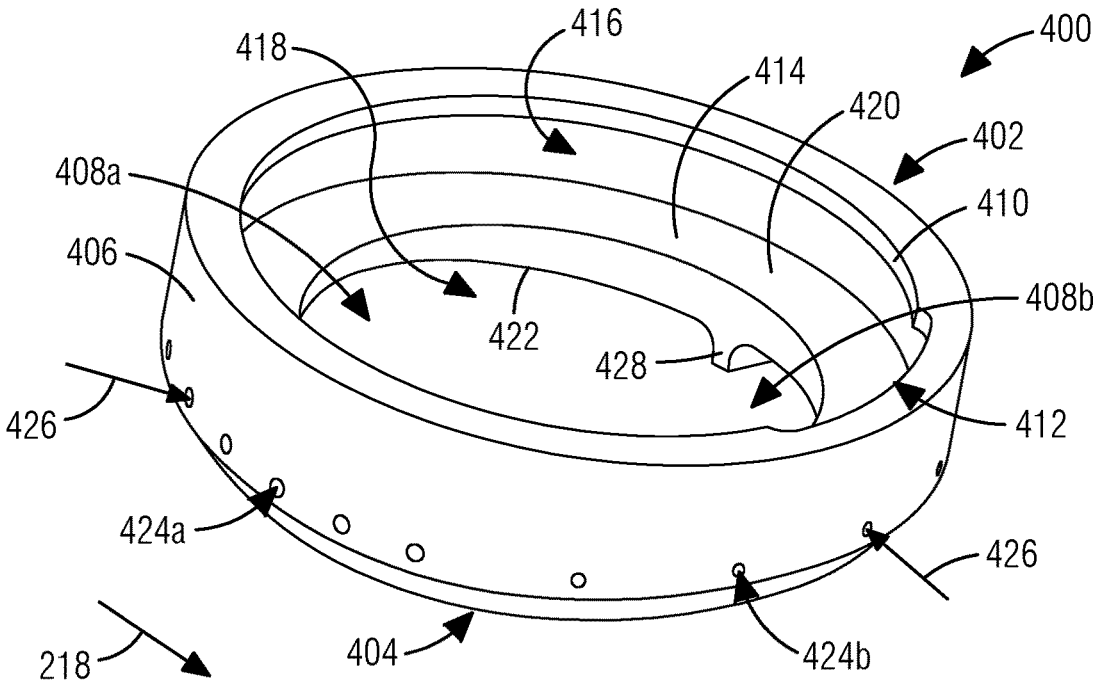
FIG. 4 illustrates a perspective view of a collar suitable for use in a secondary fuel injector illustrated in FIG. 3.
Figure 5:
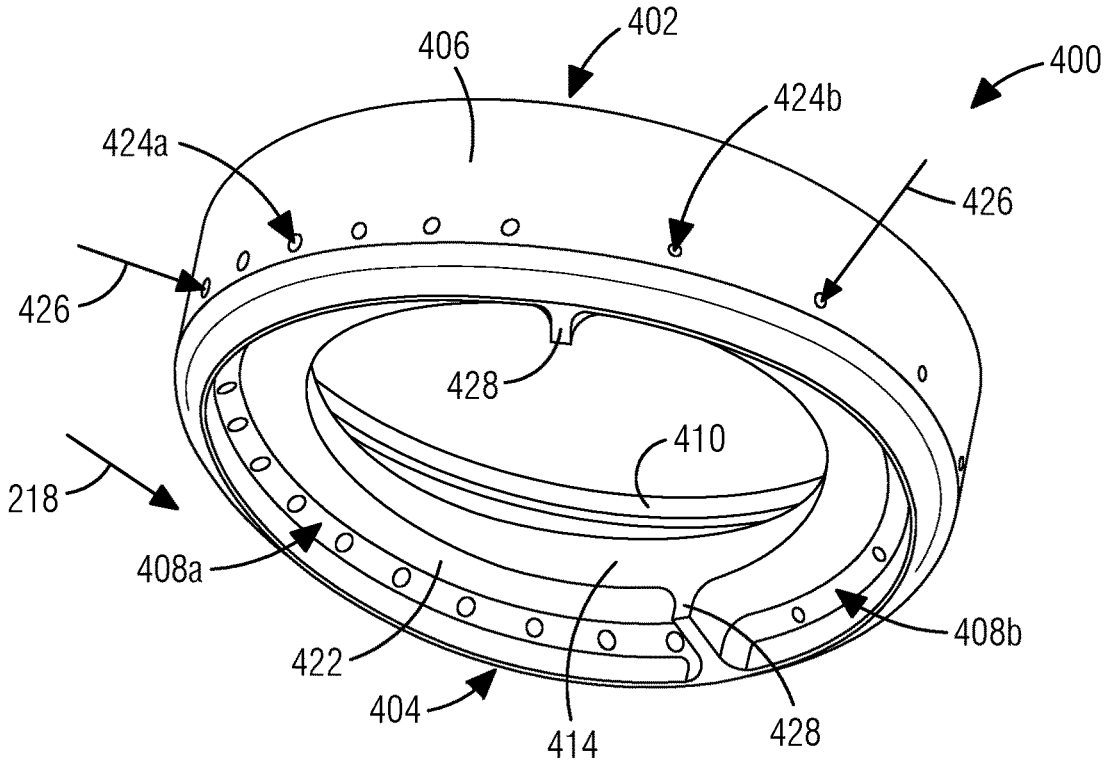
FIG. 5 illustrates a perspective view of the collar of FIG. 4 oriented in a different view direction than in FIG. 4.

FIG. 4 illustrates a perspective view of the collar 400 suitable for use in the secondary fuel injector 222 of FIG. 3. FIG. 5 illustrates a perspective view of the collar 400 as illustrated in FIG. 4 that is oriented in a different view direction than in FIG. 4.

With references to FIG. 4 and FIG. 5, the collar 400 has a general cylindrical shape having a first end 402, a second end 404, and a wall 406 between the first end 402 and the second end 404. The second end 404 is fixed on the transition duct 210. The first end 402 is opposite to the second end 404 positioned exterior of the transition duct 210. The wall 406 is generally annular and encloses a hollow interior for disposing the secondary fuel injector 222. The wall 406 may be chamfered toward the second end 404 for coupling the collar 400 to the transition duct 210, such as by welding. The first end 402 is generally flat. The second end 404 is non-planar. The non-planar shape of the second end 404 mates with a shape of the transition duct 210 for fixing the second end 404 to the transition duct 210. The non-planar shape includes a saddle shape, or a hyperbolic paraboloid shape.

The collar 400 has an upstream portion **408*a* and a downstream portion 408*b*. The upstream portion 408*a* and the downstream portion 408*b* are defined with respect to a flow direction of the exhaust gas 218. The upstream portion 408*a* has a larger circumferential length around a perimeter of the collar 400 than the downstream portion 408*b*. It is also possible that the upstream portion 408*a* is equal to the downstream portion 408*b***.

The collar 400 has a lip 410 extending radially inward from an inner surface of the collar 400 and circumferentially around the inner surface. The lip 410 is disposed at the first end 402 of the collar 400 and is flush with the first end 402. The lip 410 has a cutout 412. The cutout 412 can be disposed at the downstream portion **408*b* of the collar 400. The location of the cutout 412 may be used to identify the downstream portion 408*b* of the collar 400 (i.e., the orientation) for installation of the collar 400. It is also possible to have the cutout 412 located at the upstream portion 408*a* of the collar 400 to identify upstream portion 408*a* of the collar 400 when installing the collar 400. Additionally, other methods or features (e.g., grooves, marks, notches, etc.) could be formed on the collar 400** to identify its orientation.

The collar 400 has a flap 414 extending radially inward from the inner surface of the wall 406 and circumferentially around the inner surface. The flap 414 divides the interior of the collar 400 into a first cavity 416 and a second cavity 418. The first cavity 416 is defined between the first end 402 and the flap 414, practically, the first cavity 416 is defined between the lip 410 and the flap 414. The second cavity 418 is defined between the flap 414 and the second end 404. The flap 414 has a first surface 420 facing toward the first end 402 of the collar 400 and a second surface 422 facing toward the second end 404 of the collar 400. The first surface 420 is flat and is parallel to the lip 410. The second surface 422 is non-planar. The non-planar shape of the second surface 422 corresponds to the non-planar shape of the second end 404. The non-planar shape includes a saddler shape, or a hyperbolic paraboloid shape. As such, a distance between the second surface 422 of the flap 414 and the second end 404 of the collar 400 is constant around the collar 400. This arrangement results in a constant circumferential cross-sectional area (i.e., the area defined between the flap 414 and the second end 404 of the collar 400 and the inner surface of the collar 400 and the secondary fuel injector 222) of the second cavity 418.

The collar 400 includes a plurality of upstream apertures 424*a* and a plurality of downstream apertures 424*b*. The upstream apertures 424*a* are disposed at least partially in the upstream portion 408*a* and cooperate to define a portion of an upstream purge path. The downstream apertures 424*b* are disposed at least partially in the downstream portion 408*b* and cooperate to define a portion of a downstream purge path. The upstream apertures 424*a* and the downstream apertures 424*b* are distributed circumferentially around the wall 406 and spaced apart from each other. The upstream apertures 424*a* and the downstream apertures 424*b* are disposed in the second cavity 418 of the collar 400. The upstream apertures 424*a* and the downstream apertures 424*b* allow cooling air 426 flowing from an exterior of the collar 400 to the interior of the collar 400.

The collar 400 includes two ribs 428 that extend radially inward from the second surface 422 of the flap 414 toward the second end 404. The two ribs 428 also extend from the inner surface of the wall 406. The two ribs 428 extend perpendicular to the second surface 422 of the flap 414. The two ribs 428 extend perpendicular to the inner surface of the wall 406. The two ribs 428 are disposed at two locations of the flap 414 to separate the upstream portion 408*a* and the downstream portion 408*b* in the second cavity 418. As illustrated in FIG. 4 and FIG. 5, the two ribs 428 are disposed less than 180 degrees apart from each other at a downstream side with respect to the flow direction of the exhaust gas 218. It is also possible that the two ribs 428 are disposed 180 degree apart from each other.

The cooling air 426 performs as a purge air to purge the collar 400. A flow area of the upstream purge path is defined by the total area of the upstream apertures 424*a*. A flow area of the downstream purge path is defined by the total area of the downstream apertures 424*b*. The flow area of the upstream purge path is larger than the flow area of the downstream purge path. Such a configuration can be achieved by different sizes of the upstream apertures 424*a* and the downstream apertures 424*b*, different total number of the upstream apertures 424*a* and the downstream apertures 424*b*, different circumferential length of the upstream portion 408*a* and the downstream portion 408*b*, or combinations thereof.

As illustrated in FIG. 4 and FIG. 5, sizes of the upstream apertures 424*a* are larger than sizes of the downstream apertures 424*b*. Each upstream aperture 424*a* has a first diameter and each downstream aperture 424*b* has a second diameter that is smaller than the first diameter. The total number of the upstream apertures 424*a* disposed in the upstream portion 408*a* is more than the total number of the downstream apertures 424*b* disposed in the downstream portion 408*b*. A distance between adjacent upstream apertures 424*a* is equal. A distance between adjacent downstream apertures 424*b* is equal. The distance between adjacent upstream apertures 424*a* is less than the distance between adjacent downstream apertures 424*b*. The upstream portion 408*a* has a larger circumferential length around a perimeter of the collar 400 than the downstream portion 408*b*. The two ribs 428 separate the upstream portion 408*a* and the downstream portion 408*b* in the second cavity 418. Other arrangements that achieve the larger flow area of the upstream purge path than the downstream purge path is also possible.

Figure 6:
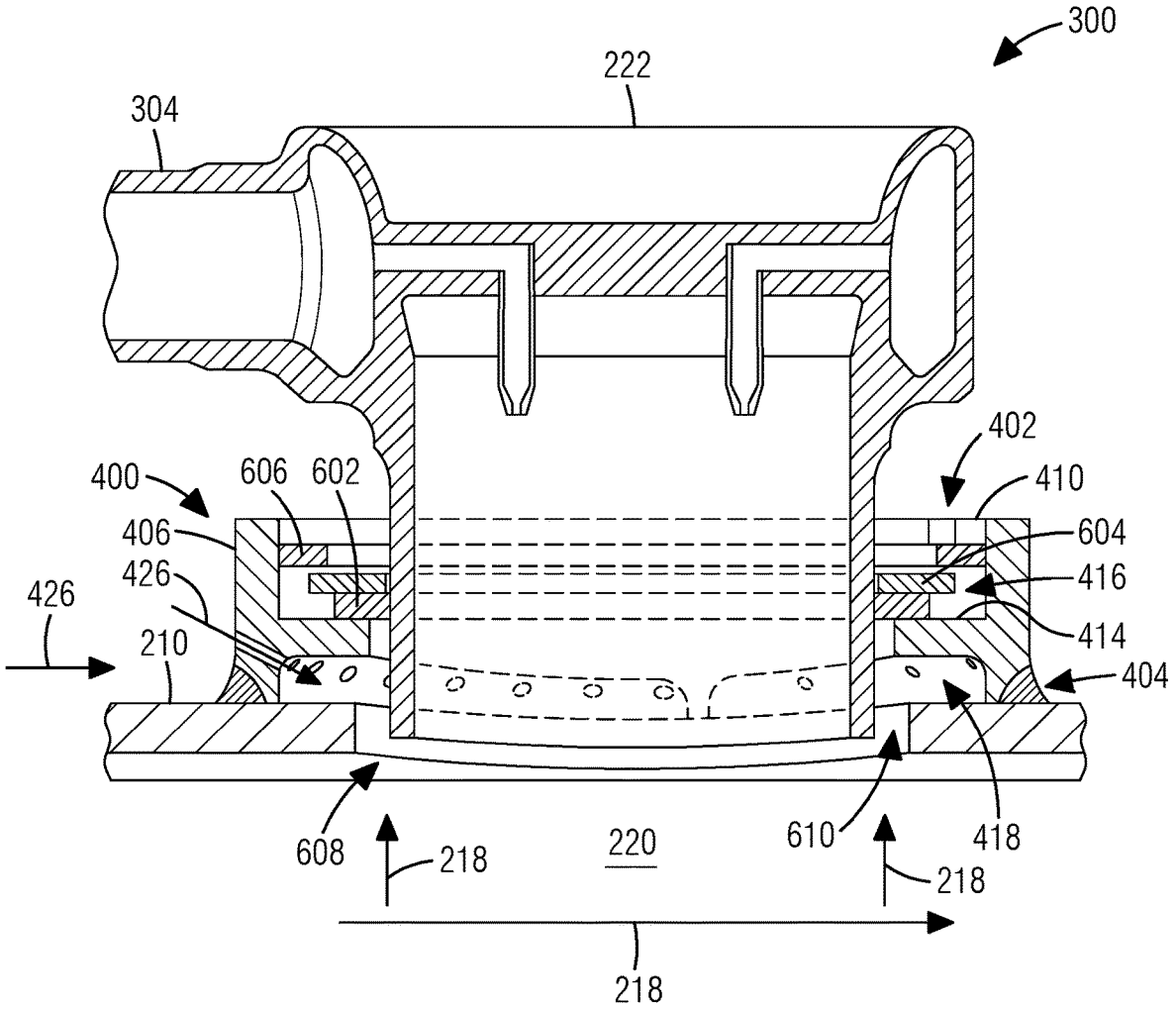
FIG. 6 illustrates a cross-section view of a portion of the combustor of FIG. 3 showing the secondary fuel injector and the collar.

FIG. 6 illustrates a cross-section view of a portion of the combustor 300 showing the secondary fuel injector 222 and the collar 400. The fuel is supplied to the secondary fuel injector 222 via the fuel supply tube 304. The secondary fuel injector 222 provides further fuel to the exhaust gas 218 downstream from the premixer fuel injector 212 to improve the overall combustion in the combustion chamber 220.

The collar 400 receives a seal ring 602, a shim ring 604, and a snap ring 606 each disposed in the first cavity 416 between the lip 410 and the flap 414. The seal ring 602 is disposed on the flap 414. The shim ring 604 is disposed on the seal ring 602. The snap ring 606 is disposed on the shim ring 604. The lip 410 holds the seal ring 602, the shim ring 604, and the snap ring 606 within the first cavity 416. The cutout 412 is used for assembly and disassembly of the seal ring 602, the shim ring 604, and the snap ring 606 placed in the first cavity 416 of the collar 400.

The secondary fuel injector 222 is disposed in an opening 608 defined by the transition duct 210. A gap 610 exists between the secondary fuel injector 222 and the opening 608. The opening 608 has an upstream side and a downstream side defined by the flow direction of exhaust gas 218.

The second end 404 of the collar 400 is fixed on the transition duct 210 around the opening 608. The first end 402 of the collar 400 is opposite to the second end 404 positioned exterior of the transition duct 210. The collar 400 is oriented such that the upstream portion 408*a* faces the upstream side of the opening 608 and the downstream portion 408*b* faces the downstream side of the opening 608.

The upstream apertures 424*a* and the downstream apertures 424*b* extend through the collar 400. Outlets of the upstream apertures 424*a* and the downstream apertures 424*b* are located in the second cavity 418 of the collar 400. The upstream apertures 424*a* and the downstream apertures 424*b* are oblique to the flow direction of the exhaust gas 218. The upstream apertures 424*a* and the downstream apertures 424*b* are oriented such that the cooling air 426 exits the upstream apertures 424*a* and the downstream apertures 424*b* in a direction towards the transition duct 210.

In operation of the gas turbine engine 100 and with reference to FIG. 2, the compressed air 206 enters the head-end section 208 and is mixed with fuel injected by the premixer fuel supply tube 214. The air/fuel mixture is ignited by the pilot burner 216 forming the exhaust gas 218. The exhaust gas 218 flows within the transition duct 210 in a flow direction. Turning to FIG. 6, the exhaust gas 218 can enter the second cavity 418 of the collar 400 through the gap 610 between the secondary fuel injector 222 and the transition duct 210. This may cause ingestion of the exhaust gas 218. The cooling air 426 flows into the second cavity 418 from the exterior of the transition duct 210 through the upstream purge path that is defined by the upstream apertures 424*a*. The cooling air 426 also flows into the second cavity 418 from the exterior of the transition duct 210 through the downstream purge path that is defined by the downstream apertures 424*b*. The cooling air 426 performs as a purge air to purge the second cavity 418 of the collar 400. The purge reduces the ingestion of the exhaust gas 218. The seal ring 602 makes the cooling air 426 flow through the upstream apertures 424*a* and the downstream apertures 424*b* from the exterior of the transition duct 210 into the second cavity 418. The seal ring 602 also seals the cooling air 426 and the exhaust gas 218 within the second cavity 418. The cooling air 426 is a flow of the compressed air 206 to cool the transition duct 210. After purging the second cavity 418 of the collar 400, the cooling air 426 flows into the transition duct 210 and is mixed with the exhaust gas 218 in the combustion chamber 220. The cooling air 426 at least partially participates in a combustion process of the fuel injected by the secondary fuel injector 222 into the exhaust gas 218. The mixture of the cooling air 426 and the exhaust gas 218 continues in the flow direction and ultimately exits the combustor 300 at the transition exit frame 302 and enters the turbine section 106, as shown in FIG. 2 and FIG. 3.

In some constructions, an asymmetric purge flow through the collar 400 is desired. The upstream portion 408*a* of the collar 400 has more ingestion of the exhaust gas 218 than the downstream portion 408*b* of the collar 400. As such, the upstream portion 408*a* needs a higher purge flow than the downstream portion 408*b*. The larger flow area of the upstream purge path provides a larger purge flow to the upstream portion 408*a*. The less flow area of the downstream purge path provides a less purge flow to the downstream portion 408*b*. The arrangement of the upstream purge path and the downstream purge path makes the collar 400 fit the asymmetric purge desire through the collar 400, thereby reducing the consumption of the cooling air 426.

The second cavity 418 is compartmentalized by the two ribs 428. Without the two ribs 428, the cooling air 426 in the upstream portions 408*a* communicates to the cooling air 426 in the downstream portion 408*b* due to a lower static pressure in the downstream portion 408*b*. With the two ribs 428, the cooling air 426 in the upstream portions 408*a* remains in the upstream portion 408*a* and does not communicate with the cooling air 426 in the downstream portion 408*b*. The constant circumferential cross-sectional area of the second cavity 418 improves a distribution of the cooling air 426 in the second cavity 418 to provide an effective cooling and purge.

The asymmetric and compartmentalized collar 400 improves purge performance in the gap 610 and reduces the ingestion of the exhaust gas 218 in the collar 400. The asymmetric and compartmentalized collar 400 reduces the cooling air 426 consumption and the improves an overall combustion. The asymmetric and compartmentalized collar 400 improves design life of the gas turbine engine 100. The asymmetric and compartmentalized collar 400 can control the amount of the cooling air 426 as the purge air to meet the purge need.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

LISTING OF DRAWING ELEMENTS

100 gas turbine engine
102 compressor section
104 combustion section
106 turbine section
108 central axis
110 compressor stage
112 stationary compressor vane
114 rotating compressor blade
116 rotor
118 inlet section
120 combustor
122 exhaust gas
124 turbine stage
126 stationary turbine vane
128 rotating turbine blade
130 turbine inlet
132 exhaust portion
134 control system
200 combustion section
202 casing
204 compressor exit diffusor
206 compressed air
208 head-end section
210 transition duct
212 premixer fuel injector
214 premixer fuel supply tube
216 pilot burner
218 exhaust gas
220 combustion chamber
222 secondary fuel injector
300 combustor
302 transition exit frame
304 fuel supply tube
306 fuel plenum ring
400 collar
402 first end
404 second end
406 wall
408*a* upstream portion
408*b* downstream portion
410 lip
412 cutout
414 flap
416 first cavity
418 second cavity
420 first surface
422 second surface
424*a* upstream aperture
424*b* downstream aperture
426 cooling air
428 rib
602 seal ring
604 shim ring
606 snap ring
608 opening
610 gap

What is claimed is:

1. A combustor comprising:

a premixer fuel injector that injects a fuel into the combustor and ignites a mixture of the fuel and a compressed air to produce an exhaust gas;

a transition duct defining an interior through which the exhaust gas passes, the transition duct defining an opening therethrough, the opening having an upstream side and a downstream side defined by a flow direction of the exhaust gas;

a secondary fuel injector disposed in the opening that injects further fuel to the exhaust gas; and a collar fixedly coupled to the transition duct and positioned to surround the secondary fuel injector, the collar having a first end positioned to an exterior of the transition duct, a second end fixed on the transition duct around the opening, and a wall therebetween, the collar cooperating with the secondary fuel injector to define an upstream purge path at least partially disposed on the upstream side and a downstream purge path at least partially disposed on the downstream side that each provides a flow communication between the exterior of the transition duct and the interior of the transition duct, the upstream purge path having a larger flow area than the downstream purge path, wherein the second end of the collar has a non-planar shape that mates with a shape of the transition duct, wherein the collar comprises a flap that extends from an inner surface of the collar and circumferentially around the inner surface, and wherein the flap divides an interior of the collar to a first cavity between the flap and the first end and a second cavity between the flap and the second end, and wherein the collar comprises two ribs that extend from the inner surface of the collar and extend from a surface of the flap facing the second end of the collar, and wherein the upstream purge path and the downstream purge path are defined in the second cavity and are separated by the two ribs.

2. The combustor of claim 1, wherein the collar comprises a plurality of upstream apertures facing the upstream side of the opening and a plurality of downstream apertures facing the downstream side of the opening, and wherein the plurality of upstream apertures define the upstream purge path and the plurality of downstream apertures define the downstream purge path.

3. The combustor of claim 2, wherein a size of each upstream aperture of the plurality of upstream apertures is larger than a size of each downstream aperture of the plurality of downstream apertures.

4. The combustor of claim 2, wherein a total number of the plurality of the upstream apertures is more than a total number of the plurality of the downstream apertures.

5. The combustor of claim 2, wherein the plurality of upstream apertures and the plurality of downstream apertures extend through the wall and are oblique to the flow direction of the exhaust gas.

6. The combustor of claim 1, wherein the upstream purge path has a larger circumferential length around a perimeter of the collar than the downstream purge path.

7. The combustor of claim 1, wherein a surface of the flap facing the second end of the collar has a non-planar shape corresponding to the non-planar shape of the second end to form a constant circumferential cross-sectional area of the second cavity.

8. The combustor of claim 1, wherein the two ribs are disposed less than 180 degrees apart from each other at the downstream side.

9. A combustor comprising:

a transition duct defining an interior through which a flow of combustion gas passes in a flow direction, the transition duct defining an opening therethrough, the opening having an upstream side and a downstream side defined by the flow direction;

a primary fuel injector;

a secondary fuel injector at least partially disposed within the opening to inject fuel into the flow of combustion gas; and a collar having a first end and a second end, wherein the second end is fixedly coupled to the transition duct and positioned to surround the opening, the collar cooperating with the secondary fuel injector to define an upstream purge path at least partially disposed on the upstream side of the opening and a downstream purge path at least partially disposed on the downstream side of the opening that each provides a flow communication between an exterior of the transition duct and the interior of the transition duct, the upstream purge path having a larger flow area than the downstream purge path, wherein the second end of the collar has a smooth non-planar shape that mates with a shape of the transition duct, wherein the collar comprises a flap that extends from an inner surface of the collar and circumferentially around the inner surface, and wherein the flap divides an interior of the collar to a first cavity between the flap and the first end and a second cavity between the flap and the second end, and wherein the collar comprises two ribs that extend from the inner surface of the collar and extend from a surface of the flap facing the second end of the collar, and wherein the upstream purge path and the downstream purge path are defined in the second cavity and are separated by the two ribs.

10. The combustor of claim 9, wherein the collar comprises a plurality of upstream apertures facing the upstream side of the opening and a plurality of downstream apertures facing the downstream side of the opening, and wherein the plurality of upstream apertures define the upstream purge path and the plurality of downstream apertures define the downstream purge path.

11. The combustor of claim 10, wherein a size of each upstream aperture of the plurality of upstream apertures is larger than a size of each downstream aperture of the plurality of downstream apertures.

12. The combustor of claim 10, wherein a total number of the plurality of upstream apertures is more than a total number of the plurality of downstream apertures.

13. The combustor of claim 10, wherein the plurality of upstream apertures and the plurality of downstream apertures extend through the collar and are oblique to the flow direction of the combustion gas.

14. The combustor of claim 9, wherein the upstream purge path has a larger circumferential length around a perimeter of the collar than the downstream purge path.

15. The combustor of claim 9, wherein the first end is positioned to the exterior of the transition duct and the second end is fixed on the transition duct.

16. The combustor of claim 9, wherein a surface of the flap facing the second end of the collar has a non-planar shape corresponding to the non-planar shape of the second end to form a constant circumferential cross-sectional area of the second cavity.

17. The combustor of claim 9, wherein the two ribs are disposed less than 180 degrees apart from each other at the downstream side.

18. A combustor comprising:

a transition duct defining an interior through which a flow of combustion gas passes in a flow direction, the transition duct defining an opening therethrough, the opening having an upstream side and a downstream side defined by the flow direction;

a primary fuel injector;

a secondary fuel injector at least partially disposed within the opening to inject fuel into the flow of combustion gas; and a collar having a first end and a second end, wherein the second end is fixedly coupled to the transition duct and positioned to surround the opening, the collar cooperating with the secondary fuel injector to define an upstream purge path at least partially disposed on the upstream side of the opening and a downstream purge path at least partially disposed on the downstream side of the opening that each provides a flow communication between an exterior of the transition duct and the interior of the transition duct, the upstream purge path having a larger flow area than the downstream purge path, wherein the collar comprises a plurality of upstream apertures facing the upstream side of the opening and a plurality of downstream apertures facing the downstream side of the opening, and wherein the plurality of upstream apertures define the upstream purge path and the plurality of downstream apertures define the downstream purge path, wherein a size of each upstream aperture of the plurality of upstream apertures is larger than a size of each downstream aperture of the plurality of downstream apertures, wherein a total number of the plurality of upstream apertures is more than a total number of the plurality of downstream apertures, wherein the upstream purge path has a larger circumferential length around a perimeter of the collar than the downstream purge path, and wherein the upstream purge path and the downstream purge path are separated by two ribs disposed in an inner surface of the collar, wherein the second end of the collar has a non-planar shape that mates with a shape of the transition duct, wherein the collar comprises a flap that extends from an inner surface of the collar and circumferentially around the inner surface, and wherein the flap divides an interior of the collar to a first cavity between the flap and the first end and a second cavity between the flap and the second end, and wherein the two ribs extend from the inner surface of the collar and extend from a surface of the flap facing the second end of the collar, and wherein the upstream purge path and the downstream purge path are defined in the second cavity and are separated by the two ribs.

19. The combustor of claim 1, wherein the second end of the collar has a hyperbolic paraboloid shape.

* * * * *